US009651324B2

(12) United States Patent
Hayes et al.

(10) Patent No.: US 9,651,324 B2
(45) Date of Patent: May 16, 2017

(54) DUAL STACK MAGAZINE

(71) Applicant: Outlander LLC, Eagle, ID (US)

(72) Inventors: Steve Hayes, Eagle, ID (US); Roy Chester, Eagle, ID (US)

(73) Assignee: OUTLANDER LLC, Eagle, ID (US)

( * ) Notice: Subject to any disclaimer, the term of this patent is extended or adjusted under 35 U.S.C. 154(b) by 0 days.

(21) Appl. No.: 14/490,945

(22) Filed: Sep. 19, 2014

(65) Prior Publication Data

US 2015/0075050 A1 Mar. 19, 2015

Related U.S. Application Data

(60) Provisional application No. 61/879,920, filed on Sep. 19, 2013.

(51) Int. Cl.

| | |
|---|---|
| ***F41A 9/61*** | (2006.01) |
| ***F41A 9/66*** | (2006.01) |
| ***F41A 9/70*** | (2006.01) |

(52) U.S. Cl.
CPC . *F41A 9/66* (2013.01); *F41A 9/70* (2013.01)

(58) Field of Classification Search
CPC ..... F41A 9/65; F41A 9/66; F41A 9/68; F41A 9/69; F41A 9/82; F41A 9/24
USPC ..... 42/49.01, 49.02, 50
See application file for complete search history.

(56) References Cited

U.S. PATENT DOCUMENTS

| | | | | |
|---|---|---|---|---|
| 3,226,869 | A * | 1/1966 | Musgrave | 42/50 |
| 4,589,218 | A * | 5/1986 | Teppa | 42/50 |
| 2010/0126053 | A1* | 5/2010 | Fitzpatrick et al. | 42/50 |
| 2010/0269389 | A1* | 10/2010 | Lopez Laparra | 42/49.01 |
| 2011/0173857 | A1* | 7/2011 | Hogan, Jr. | 42/50 |
| 2012/0131831 | A1* | 5/2012 | Sullivan et al. | 42/50 |
| 2013/0247437 | A1* | 9/2013 | Obermeit | 42/49.01 |

* cited by examiner

*Primary Examiner* — Gabriel Klein
(74) *Attorney, Agent, or Firm* — Parsons Behle & Latimer

(57) ABSTRACT

Embodiments of a magazine 10 for storing cartridges 30 for use with a firearm are disclosed. The magazine 10 may include a stack divider 50 that creates at least two spaces for stacks of cartridges 30. The magazine 10 may also include feed lips 40 that have an entry point 41 sized to allow the cartridges to be loaded with a single straight-in motion.

11 Claims, 6 Drawing Sheets

DUAL STACK MAGAZINE

CROSS-REFERENCE TO RELATED APPLICATIONS

This disclosure is related to, and claims under 35 U.S.C. §119(e) the benefit of provisional application Ser. No. 61/879,920, titled "Dual Stack Magazine," and filed Sep. 19, 2013.

FIELD OF THE DISCLOSURE

The disclosure relates generally to firearm magazines for holding ammunition. In particular, the disclosure relates to a magazine for rimmed cartridges.

BACKGROUND

In general, magazines for rimmed cartridges require the cartridge to be inserted by performing a two-step process of pushing the cartridge first down, and then back in to the magazine. This can be time consuming and tiresome, in particular, when loading a relatively large, multiple cartridge magazine.

In addition, it is desirable to be able to carry as many cartridges as desired in a relatively small and compact magazine to facilitate, among other things, the ease of transport and use of the firearm. Other drawbacks of presently available systems also exist.

SUMMARY

Accordingly, the present disclosure is related to a magazine for rimmed cartridges that addresses the above-noted, and other, drawbacks of existing systems.

In addition, the present disclosure provides a magazine for rimmed cartridges that enables a one-step insertion process for cartridges by pushing them straight down into the magazine.

In addition, the present disclosure provides a magazine for rimmed cartridges that is relatively compact and easy to use with a firearm.

Accordingly, there is provided embodiments of a magazine for cartridges for use with a firearm, the magazine comprising a housing, a stack divider; and feed lips. In some embodiments, the feed lips further comprise an entry point sized to allow the passing of a cartridge straight through, and at least one lip shaped to engage the cartridge and hold the cartridge in place within the housing.

In some embodiments, the magazine may further comprise a spring plate, and a biasing component, wherein the spring plate and biasing component provide a biasing force that causes the cartridge to engage the at least one lip and hold the cartridge within the housing.

In still other embodiments the magazine may hold a cartridge that comprises a rimmed cartridge and the stack divider further comprises a rib shaped to engage at least a portion of a rim on the rimmed cartridge. In further embodiments, the magazine the rib substantially confines the rimmed cartridge from moving laterally in the housing.

In still other embodiments, the stack divider is positioned substantially in the center of the housing and forms spaces for at least two stacks of cartridges within the housing.

In still other embodiments, the feed lips further comprise a second lip shaped to engage the cartridge and hold the cartridge in place within the housing, and wherein the at least one lip and the second lip are located on opposite sides of the entry point.

In still other embodiments the feed lips further comprise a second lip shaped to engage the cartridge and hold the cartridge in place within the housing, wherein the at least one lip and the second lip are located on opposite sides of the entry point, and wherein the at least one lip and the second lip are located over respective ones of the spaces for at least two stacks of cartridges within the housing.

In still other embodiments, the stack divider is a single piece and is curved. In further embodiments, the stack divider comprises a more curved portion near the feed lips and a relatively straight or slightly curved portion at the opposing end.

In still other embodiments, the housing further comprises housing grooves. In some embodiments, the housing grooves are located adjacent the rib portion of the stack divider and are shaped to engage at least a portion of a rim on a rimmed cartridge and substantially confine the rimmed cartridge from moving laterally in the housing.

Other advantages and features of the presently disclosed system also exist.

Figure 1:
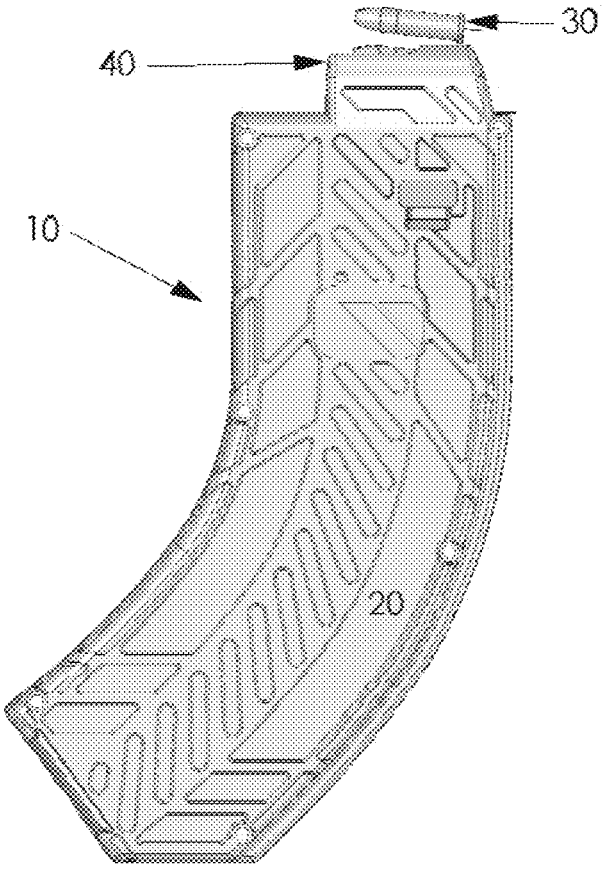
FIG. 1 is a side view of embodiments of the magazine in accordance with the disclosure.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DETAILED DESCRIPTION

FIG. 1 is a side view of embodiments of the magazine 10 in accordance with the disclosure. As shown, magazine 10 may comprise a housing 20 and may comprise a generally curved shape as shown. The housing 20 may be formed of any suitable material such as metal, alloys, plastics, polymers, composites, or the like. As shown, the housing 20 may be generally curved, although it need not be, in order to, among other things, facilitate holding the number of cartridges 30 desired, facilitate the smooth loading, chambering, and unloading of the same, and to ease carrying and operation of the firearm. Other shapes may also be used.

As also shown, a number of cartridges 30 may be loaded into the magazine via feed lips 40. As used herein, cartridges 30 refers to any bullet, round, shot, shell, ammunition, or the like, that may be loaded into a magazine 10. In some embodiments, cartridge 30 is a rimmed cartridge suitable for use in a 0.22 caliber firearm such as an AR-15 or the like. It is also possible to implement the disclosed magazine 10 with other cartridges, calibers, and firearms.

Figure 2:
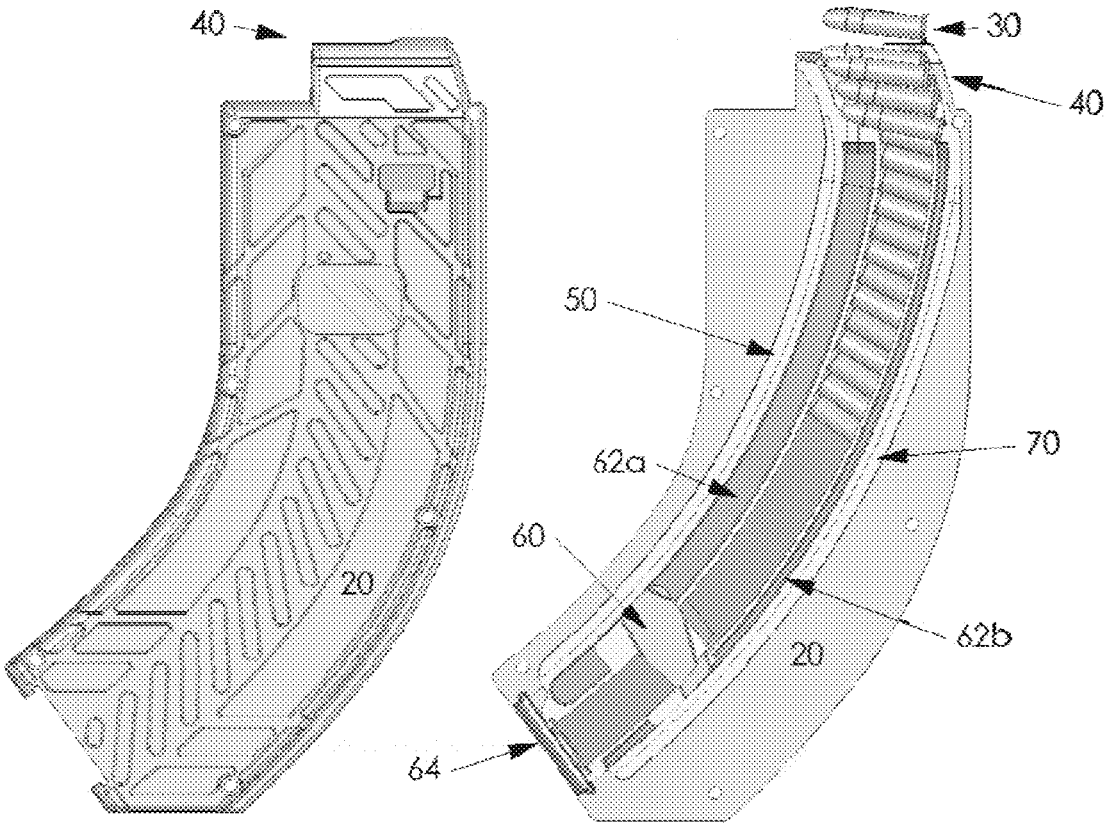
FIG. 2 is a side view with one side of the housing removed of embodiments of the magazine in accordance with the disclosure.

FIG. 2 is a side view, with one side of the housing 20 removed, of embodiments of the magazine 10 in accordance with the disclosure. As shown, magazine 10 may further comprise a stack divider 50 located between sides of the housing 20 and in communication with feed lips 40. Stack divider 50 is shaped and positioned to create at least two stacks of cartridges 30 inside the magazine 10. Stack divider 50 may be formed of any suitable material such as metal, alloys, plastics, polymers, composites, or the like. In some embodiments, stack divider 50 is formed of a unitary piece of material as a single piece. Among other things, forming stack divider 50 as a single piece adds to its strength and prevents seams or edges that may interfere with cartridge movement.

As shown, stack divider 50 may also be curved to facilitate the loading, chambering, and unloading of cartridges 30, and is also shaped to fit within the housing 20 and to facilitate the storing of the desired amount of cartridges 30. As generally shown in FIG. 2, for some embodiments the curve of stack divider 50 may have a more curved portion as shown near the feed lip 40 portion of magazine 10 and then may change to a relatively straight or slightly curved portion near the spring plate 60 end of magazine 10. A curve as shown in FIG. 2 for stack divider 50 helps prevent the cartridges 30 from getting misaligned and jammed inside magazine 10. For the embodiment and shapes shown in FIG. 2, the magazine 10 can be sized to hold at least fifty cartridges, in two stacks of twenty-five, for a 0.22 caliber cartridge 30. Other shapes, calibers, and sizes may be accommodated by stack divider 50.

As shown, and for some embodiments, stack divider 50 may be positioned substantially in the middle of housing 20 and, thus, form two locations, or spaces, for the stacks of cartridges 30 to be stored (i.e., one stack on the "left" side of stack divider 50 and one stack on the "right" side of stack divider 50). Other configurations are also possible.

As shown, magazine 10 may also comprise a spring plate 60, in communication with, or connected to, an appropriate spring (not shown), or other biasing component, to facilitate the chambering of the cartridges 30 into the firearm chamber upon cycling of the firearm's action. Spring plate 60 may be any suitable shape or size and cooperates with the biasing component to urge cartridges 30 into position for chambering in the firearm. In some embodiments, spring plate 60 may travel along appropriate grooves, ridges, slots, or the like, (e.g., 62*a*, 62*b*) in either housing 20 or stack divider 50, or both. As indicated, magazine 10 may also include a removable cover 64 that allows access to biasing component (not shown) and/or spring plate 60. In some embodiments, removable cover 64, biasing component (not shown), and spring plate 60 may be connected and removable out the bottom of magazine 10. Other spring plate 60 designs may also be implemented.

Figure 3:
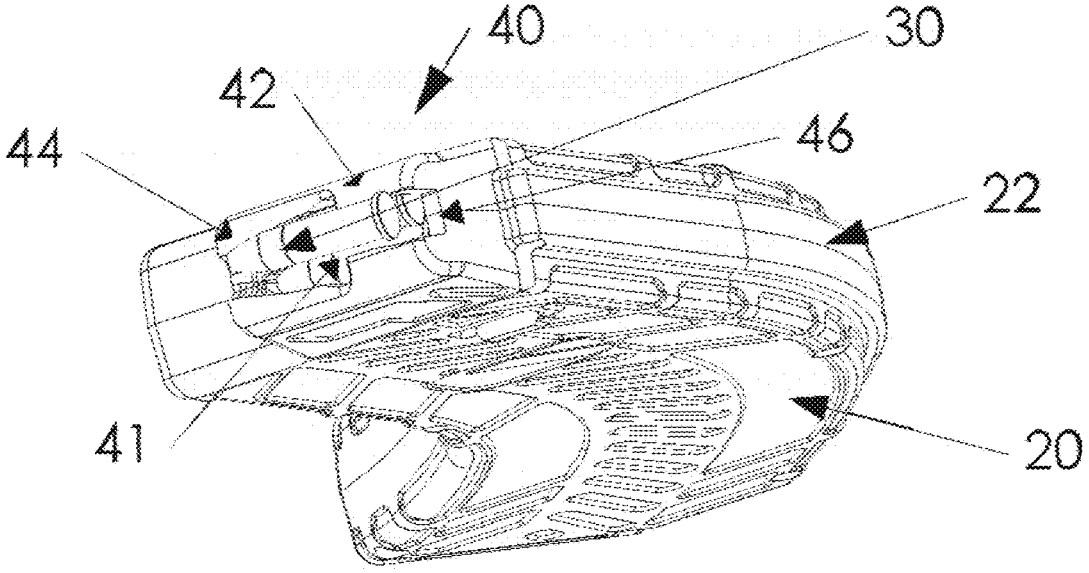
FIG. 3 is an isometric top view of embodiments of the magazine in accordance with the disclosure.

As also shown, stack separator 50 may also comprise a rib, groove, ridge, slot, or the like, as indicated at rib 70. For embodiments of magazine 10 intended to be used with rimmed cartridges 30, rib 70 may be shaped to engage at least a portion of the cartridge 30 rim and thereby guide the cartridge 30 in its travel into and out of magazine 10. In addition, rib 70 may be shaped to hold cartridges 30 in place and retain them within the magazine thereby lessening movement of the cartridges 30 within the magazine 10 and lessening the chance of misalignment and jams due to incorrect cartridge 30 positioning. For example, rib 70 may substantially prevent cartridge 30 from moving laterally, or "front to back" in the magazine 10 (i.e., left to right in FIG. 2). As best shown in FIG. 3, housing 20 may comprise a ridged portion 22 shaped to accommodate rib 70. In some embodiments ridged portion 22 may also facilitate positioning magazine 10 into the firearm by following a corresponding grove in the firearm.

FIG. 3 is an isometric top view of embodiments of the magazine 10 in accordance with the disclosure. As shown in this view, feed lips 40 may comprise several other components to facilitate the one-step straight down loading of cartridges 30 enabled by the disclosed magazine 10 (as opposed to the two-step down-and-back loading typical in existing systems). For example, embodiments of feed lips 40 may comprise a cartridge 30 entry point 41 through which cartridges 30 may be loaded into the magazine 10 and, of course, ejected out of when chambered into the firearm. Entry point 41 may be sized to be wide enough to accommodate passing a cartridge 30 straight through. As also indicated, feed lips 40 may also comprise side lips 42 that at least partially cover the locations of cartridge 30 stacks within the magazine 10. Through the combined action of stack divider 50, spring plate 60 (with biasing component, not shown), and side lips 42, a cartridge 30 that is loaded through entry point 41 will be biased against one or the other of side lips 42 and retained in the magazine 10 after the cartridge 30 is pushed straight down into the entry point 41. Embodiments of feed lips 40 may also comprise an open end 44 that facilitates, among other things, chambering of the cartridges 30. Embodiments of feed lips 44 may also include a notch 46 or the like.

Figure 4:
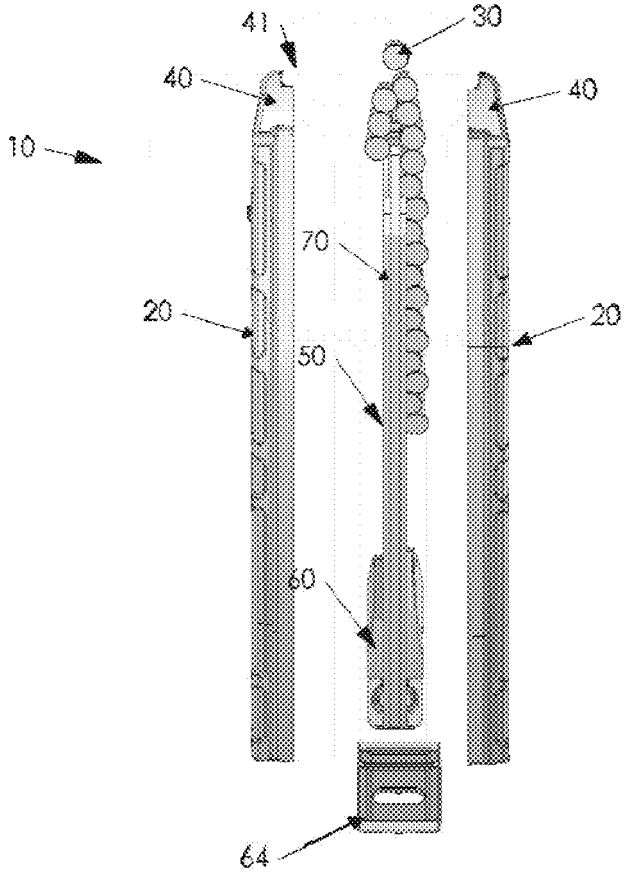
FIG. 4 is an exploded rear view of embodiments of the magazine in accordance with the disclosure.

FIG. 4 is an exploded rear view of embodiments of the magazine 10 in accordance with the disclosure. For illustrative purposes, the cartridges 30 shown in FIG. 4 do not extend or contact spring plate 60, but in practice they would. As shown in FIG. 4, cartridges 30 may be loaded into the magazine 10 by pushing them straight down into the entry point 41 of the feed lips 40. This one-step loading method is different than conventional magazines which require the cartridge 30 to first be pushed down in front of the feed lips, and then pushed towards the back of the magazine under the feed lips for loading. As indicated in the figures, feed lips 40 are designed so that it has a wide enough entry point 41 that a cartridge 30 can pass between both apposing side feed lips 42 to snap under one side and be retained.

As shown in FIG. 4, stack divider 50 separates cartridges 30 into two separate single stack columns. However, other embodiments of magazine 10 also exist, such as a magazine 10 with no stack divider 50 but still arranged to provide a double stack column of cartridges 20, or any other variation (triple stack with two dividers 50, quad stack with three dividers 50, etc.).

Figure 5:
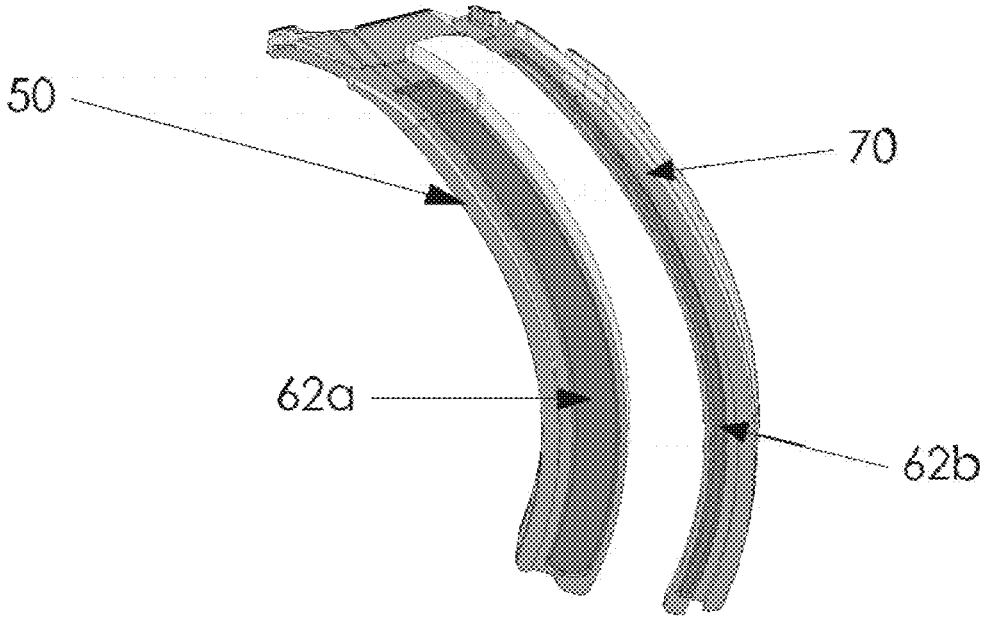
FIG. 5 is an isometric top view of embodiments of the stack divider in accordance with the disclosure.

FIG. 5 is an isometric top view of embodiments of the stack divider 50 in accordance with the disclosure. As shown, stack divider 50 may comprise grooves 62*a*, 62*b*, to facilitate travel of the spring plate 60 (not shown in FIG. 5). In addition, rib 70 is illustrated and may engage with at least a portion of a rim on a rimmed cartridge 30 to facilitate proper positioning of the cartridge 30 for loading and chambering. Of course, other shapes and sizes of rib 70 and grooves 62*a*, 62*b*, may be used.

Figure 6:
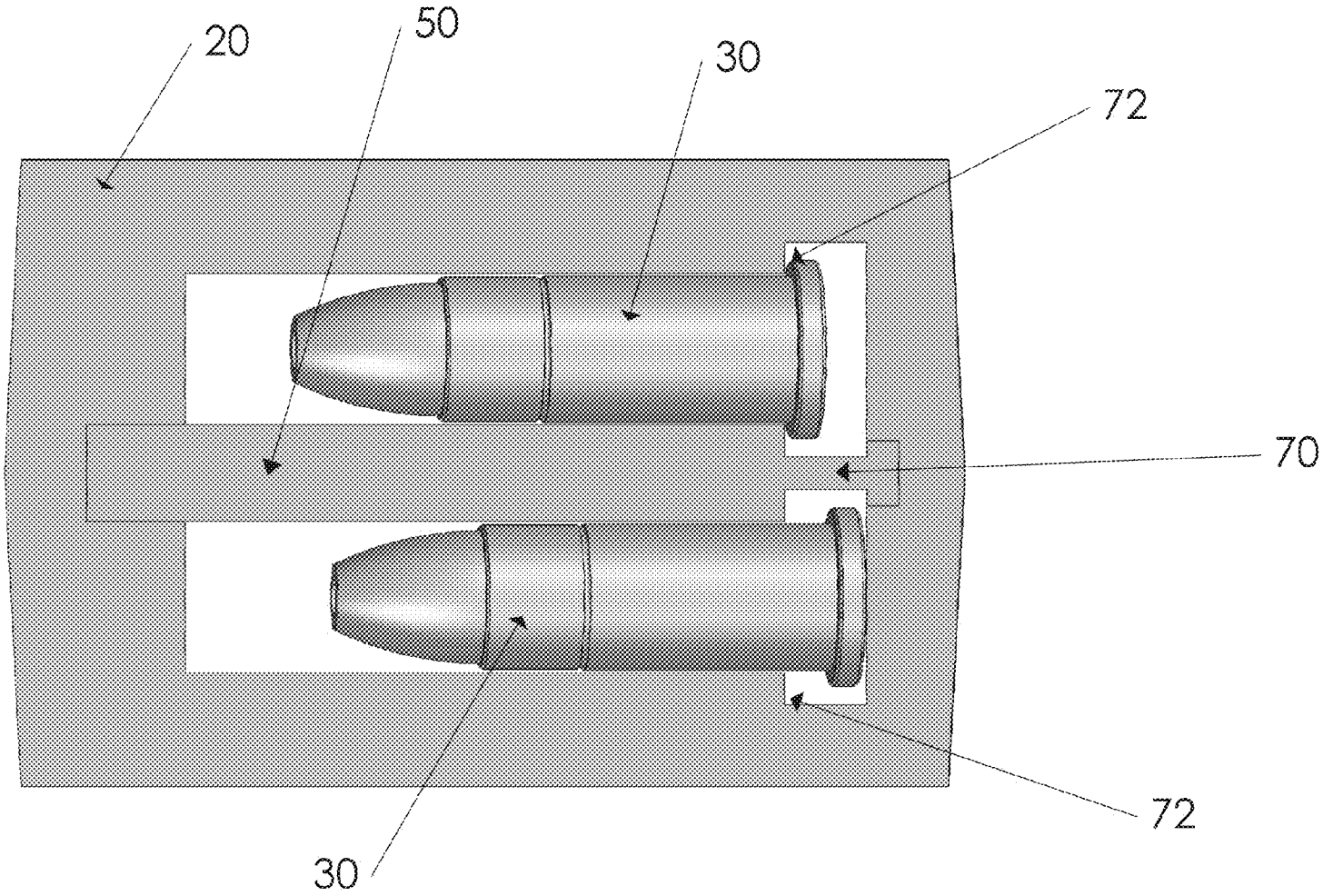
FIG. 6 is a cross-sectional view of embodiments of the magazine in accordance with the disclosure.

FIG. 6 is a cross-sectional view of embodiments of the magazine 10 in accordance with the disclosure. As shown schematically in the cross section, housing 20 may have housing grooves 72 that generally correspond to the rib 70 portion of stack divider 50. Housing grooves 72 cooperate with rib 70 portion to retain and position cartridges 30 in the proper alignment in the magazine 10. Housing grooves 72 and rib 70 are located to engage at least a portion of a rim on cartridge 30 and prevent lateral or "front to back" movement (i.e., left to right in FIG. 6) of the cartridges within the housing 20. This feature is of particular importance when cartridges 30 are not long enough to span the entire width of housing 20 and the front of the cartridge 30 does not touch both sides of the housing 20. As noted, the cooperation of housing grooves 72 and rib 70 help prevent misalignment of cartridges 30 within magazine 10.

Although various embodiments have been shown and described, the present disclosure is not so limited and will be understood to include all such modifications and variations are would be apparent to one skilled in the art.

What is claimed is:

1. A magazine for cartridges for use with a firearm, the magazine comprising:

a housing comprising a front side and a rear side and wherein when the cartridges are loaded into the magazine a bullet side of the cartridge faces the front side of the housing;

a stack divider further comprising:

a rib, proximate the rear side of the housing, and shaped to engage at least a portion of the cartridge wherein the rib substantially confines the cartridge from moving from the rear side to the front side in the housing;

and feed lips.

2. The magazine of claim 1 further comprising:

a spring plate; and a spring, wherein the spring plate and spring provide a biasing force that causes the cartridge to engage the at least one lip and hold the rimmed cartridge within the housing.

3. The magazine of claim 1 wherein the stack divider is positioned substantially in the center of the housing and forms spaces for at least two stacks of cartridges within the housing.

4. The magazine of claim 3 wherein the feed lips further comprise:

at least one lip shaped to engage the cartridge and hold the cartridge in place within the housing;

a second lip shaped to engage the cartridge and hold the cartridge in place within the housing;

wherein the at least one lip and the second lip are located on opposite sides of the entry point; and wherein the at least one lip and the second lip are located over respective ones of the spaces for at least two stacks of cartridges within the housing.

5. The magazine of claim 1 wherein the feed lips further comprise:

a second lip shaped to engage the cartridge and hold the cartridge in place within the housing; and wherein the at least one lip and the second lip are located on opposite sides of the entry point.

6. The magazine of claim 1 wherein the stack divider is a single piece.

7. The magazine of claim 1 wherein the stack divider is curved.

8. The magazine of claim 7 wherein the stack divider comprises a relatively straight or slightly curved portion near the feed lips and a more curved portion at the opposing end.

9. The magazine of claim 1 wherein the housing further comprises housing grooves.

10. The magazine of claim 9 wherein the housing grooves are located adjacent the rib and are shaped to engage at least a portion of the cartridge.

11. The magazine of claim 10 wherein the rib and the housing grooves substantially confine the cartridge from moving from the rear side to the front side in the housing.

* * * * *